US005787526A

United States Patent [19]

Smith et al.

[11] Patent Number: 5,787,526

[45] Date of Patent: Aug. 4, 1998

[54] BED WITH REMOVABLE PASSIVE RESTRAINING DEVICE FOR A USER OF THE BED

[75] Inventors: Barbara Jean Smith, Rte. 2 Box 346, Norwood, Mo. 65717; Marsha Ann Mastrangelo, Norwood, Mo.

[73] Assignee: Barbara Jean Smith, Norwood, Mo.

[21] Appl. No.: 865,514

[22] Filed: May 30, 1997

[51] Int. Cl.[6] ..... A47C 21/08; A47G 9/00

[52] U.S. Cl. ..... 5/424; 5/494; 128/869; 128/872

[58] Field of Search ..... 5/424, 629, 494, 5/663; 128/872, 869

[56] References Cited

U.S. PATENT DOCUMENTS

| | | | |
|---|---|---|---|
| 3,134,110 | 5/1964 | Gamichon | 5/494 |
| 3,505,054 | 4/1970 | Windsor et al. | 5/424 |
| 4,214,328 | 7/1980 | Custer, Jr. et al. | 5/494 |
| 4,653,131 | 3/1987 | Diehl | 5/494 |
| 4,742,821 | 5/1988 | Wootan | 5/494 |
| 5,027,456 | 7/1991 | Wadsworth | 5/424 |
| 5,623,950 | 4/1997 | Bergeron | 5/494 |

*Primary Examiner*—Alexander Grosz

[57] ABSTRACT

The invention relates to a passive restraining device for hospital bed occupants that envelopes the bed mattress and the raised side rails and reduces the risk of the occupant of the hospital bed from falling to the floor. This is useful with debilitated, confused or patients recovering from injury or illness. The passive restraining device is comprised of a rectangular piece of fabric with two parallel longer sides, and two parallel shorter sides, with one of the shorter sides comprised of a first portion of a zipper fastener, adapted to cooperate with a second portion of a zipper fastener, the second portion being located on the other of the shorter sides, a portion of the rectangular piece of fabric being positioned under the mattress of a hospital bed, and remaining portions of the piece of fabric being elevated above the left and right side rails sufficiently to avoid contact with a user reclining on the mattress, the first and second portions of the zipper fastener being releasably connected to each other, to thereby define a tubular structure, that passively restrains a user of the bed without touching the user.

1 Claim, 3 Drawing Sheets

BED WITH REMOVABLE PASSIVE RESTRAINING DEVICE FOR A USER OF THE BED

BACKGROUND OF THE INVENTION

This invention relates to a passive restraint device. When applied to a hospital type bed with the side rails raised it prevents the occupant from putting legs over the side rails or pulling self over side rails with arms. It does not touch the occupant of the bed.

There is no other similar type device in use. Prior art devices restrict the patient to the mattress by drawing a sheet type or stretching type fabric across the body. This device does not restrict movment in the bed and the occupant can turn and reposition at will. It reduces the risk of a confused, debilitated, or recovering occupant from getting out of bed without assistance.

SUMMARY OF THE INVENTION

The "passive restrainer" device is to be applied to a hospital bed with side rails in the elevated position. It provides an envelope that wraps under the bed mattress and on top of the springs up to the outsides of the bed rails and over the top of the bed stretching across the top of the bed rails. There is a full length double sided zipper that detaches for easy removal and easy access to the occupant. The occupant can also reach the zipper pull and open the passive restrainer if so desired.

The advantage of the device is that it prevents the occupant from putting their legs over the bed rail or arms over the bed rails and in this way prevents the occupant from pulling self over the bed rails and falling to the floor. This is useful with debilitated or confused patients who may be injured from a fall or are presently injured from a fall, or have had a recent surgeries and are not yet candidates for other types of restraining devices.

The reversible separating zipper is full length and detaches at the bottom end of the bed rail on one side of the device to fold over top of bed for complete access to occupant or occupant removal. The zipper can also be placed over the center of the mattress on either side of the bed with zipper pull toward the head of the bed when in use.

The fabric is flame retardant and meets fire safety codes.

DETAILED DESCRIPTION OF DRAWINGS

Figure 1:
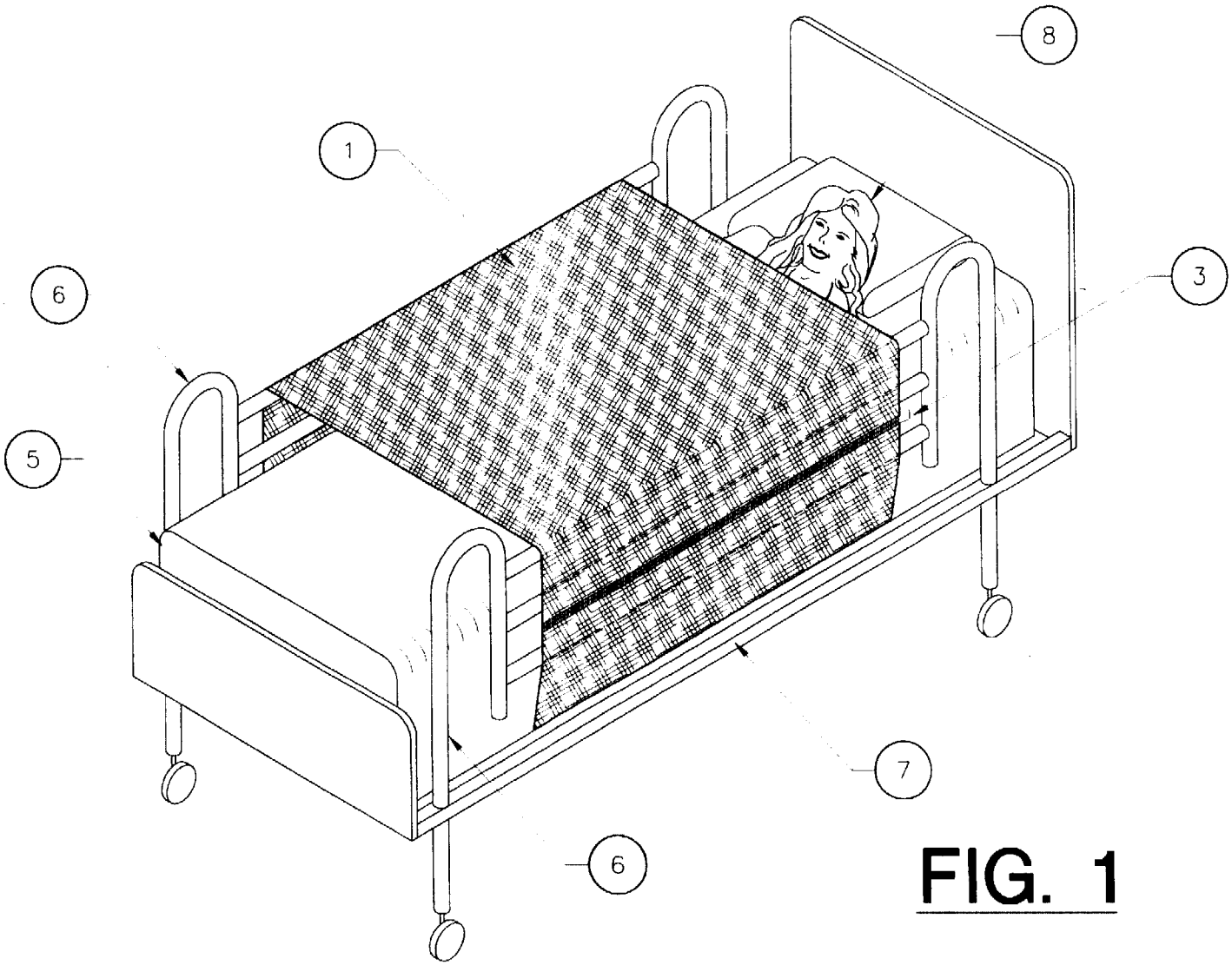
FIG. 1 Illustrates the 'passive restrainer' applied to the hospital bed with side rails raised in which a patient is sleeping.

In FIG. 1 the invention is applied to the bed, on top of the bed frame 7, and under the mattress 5. The device is then pulled up the outside of the bed rails 6 which are raised and secured with a double sided separating zipper 3. This allows for freedom of movement for the patient 8, without touching the patient 8.

Figure 2:
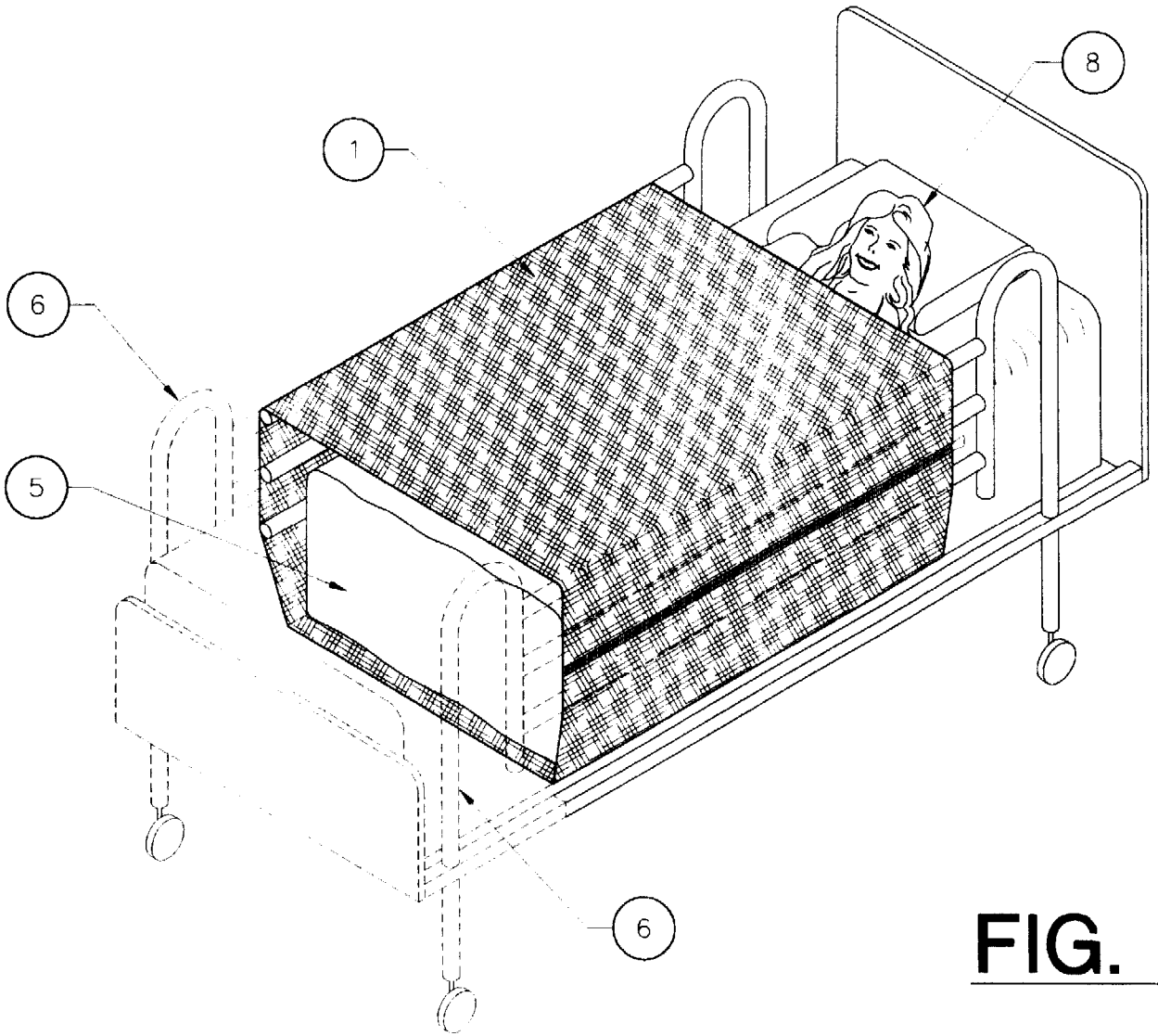
FIG. 2 Illustrates how the device is applied to the hospital bed showing the mattress cut away and the side rails defined by dotted lines.

In FIG. 2 the device is shown on the bed with mattress 5, cut away to show how the device wraps under the mattress 5, and on top of the bed frame 7, stretching over the top of the patient 8, leaving adequate room between the mattress 5, and the fabric of the device 1, applied across the top of bed rail 6, for the patient to move & turn freely.

Figure 3:
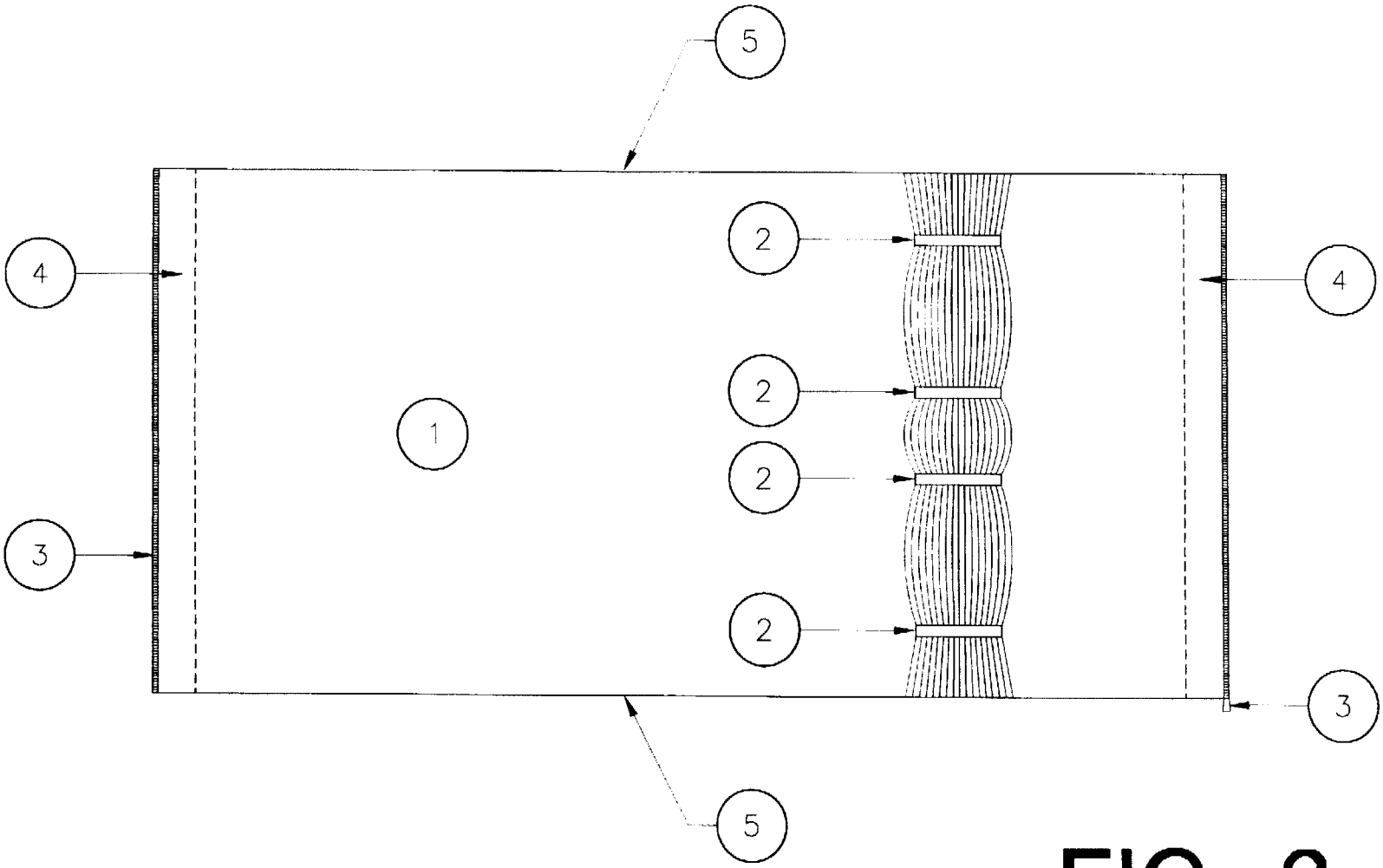
FIG. 3 Shows the invention laid out flat with the parts numbered.

In FIG. 3 The parts of the device are displayed with the device laying out flat. The fabric of the device is hemmed 5, on the long sides, with the double sided separating zipper 3, separated and sewn on the short sides. The reinforcement 4, is sewn along side of the zipper to strengthen the fabric for easier use of the zipper and the elastic 2, is sewn in 4 strips across the fabric 1, that will be placed under the mattress to allow for some adjustment for bed or mattress size.

As seen in the figures, the passive restraining device is used in combination with a bed comprised of a frame, a mattress positioned on the frame, and left and right side rails that are elevated relative to the mattress.

The passive restraining device is comprised of a rectangular piece of fabric with two parallel longer sides, and two parallel shorter sides, with one of the shorter sides comprised of a first portion of a zipper fastener, adapted to cooperate with a second portion of a zipper fastener, the second portion being located on the other of the shorter sides, a portion of the rectangular piece of fabric being positioned under a mattress, and remaining portions of the piece of fabric being elevated above the left and right side rails sufficiently to avoid contact with a user reclining on the mattress, the first and second portions of the zipper fastener being releasably connected to each other, to thereby define a tubular structure, that passively restrains a user of the bed without touching the user.

We claim:

1. In combination with a bed comprised of a frame, a mattress positioned on the frame, and left and right side rails that are elevated relative to the mattress, a passive restraining device comprised of a rectangular piece of fabric with two parallel longer sides, and two parallel shorter sides, with one of the shorter sides comprised of a first portion of a zipper fastener, adapted to cooperate with a second portion of a zipper fastener, the second portion being located on the other of the shorter sides, a portion of the rectangular piece of fabric being positioned under the mattress, and remaining portions of the piece of fabric being elevated above the left and right side rails sufficiently to avoid contact with a user reclining on the mattress, the first and second portions of the zipper fastener being releasably connected to each other, to thereby define a tubular structure, that passively restrains a user of the bed without touching the user.

* * * * *